US007263802B2

(12) United States Patent
Fitzgibbon et al.

(10) Patent No.: US 7,263,802 B2
(45) Date of Patent: Sep. 4, 2007

(54) BARRIER MOVEMENT OPERATOR HAVING SERVICE REMINDERS

(75) Inventors: James J. Fitzgibbon, Batavia, IL (US); William G. Gioia, Winfield, IL (US)

(73) Assignee: The Chamberlain Group, Inc., Elmhurst, IL (US)

( * ) Notice: Subject to any disclaimer, the term of this patent is extended or adjusted under 35 U.S.C. 154(b) by 0 days.

(21) Appl. No.: 10/931,084

(22) Filed: Aug. 31, 2004

(65) Prior Publication Data

US 2005/0022451 A1 Feb. 3, 2005

Related U.S. Application Data

(63) Continuation of application No. 10/145,799, filed on May 15, 2002.

(51) Int. Cl.
*E05F 15/20* (2006.01)

(52) U.S. Cl. ..... 49/31; 49/13

(58) Field of Classification Search ..... 49/97, 49/199, 200, 31, 13; 318/447, 471
See application file for complete search history.

(56) References Cited

U.S. PATENT DOCUMENTS

| | | | | |
|---|---|---|---|---|
| 4,336,595 | A * | 6/1982 | Adams et al. | 702/34 |
| 5,107,439 | A * | 4/1992 | Clark | 702/78 |
| 6,107,765 | A * | 8/2000 | Fitzgibbon et al. | 318/266 |
| 6,184,641 | B1 * | 2/2001 | Crimmins et al. | 318/466 |
| 6,318,024 | B1 * | 11/2001 | Krsnak et al. | 49/199 |
| 6,484,784 | B1 * | 11/2002 | Weik et al. | 160/7 |

* cited by examiner

*Primary Examiner*—Jerry Redman
(74) *Attorney, Agent, or Firm*—Fitch, Even, Tabin & Flannery

(57) ABSTRACT

An electronic service reminder to automatically notify a user as to when and what type of maintenance should be performed on the garage door operator, based on a variety of factors, including time, materials and operating environment. The garage door operator is configured to automatically generate an electronic service reminder in the form of an audible or visual alert based on one or more operating parameters of the garage door operator meeting or exceeding a predefined threshold. The predefined threshold is variable based on the values of the operating parameters.

8 Claims, 5 Drawing Sheets

BARRIER MOVEMENT OPERATOR HAVING SERVICE REMINDERS

CROSS-REFERENCE TO RELATED APPLICATION

This application is a continuation of prior application Ser. No. 10/145,799, filed May 15, 2002, which is hereby incorporated herein by reference in its entirety.

FIELD OF THE INVENTION

The present invention relates generally to barrier movement operators and, more particularly, to service reminders indicating the need for maintenance of the barrier movement operator based on diverse operating conditions.

BACKGROUND OF THE INVENTION

Garage door operators, over the years, continue to increase in sophistication through the use of advanced electronic components and control techniques. Despite such advances, a garage door operator inherently is a mechanical device, requiring the use of motors, springs, rails and other mechanical parts to raise and lower a garage door. Typically, proper maintenance of the garage door operator requires the user to lubricate the rails of the garage door operator, check for wear of the components, such as the springs, and test the system safety devices on a periodic basis. For example, it is recommended that the feature for reversing a door in response to an obstruction be tested every month. This requires the user to open the garage door fully and place a 1½" thick piece of wood (such as a 2×4 laid flat) on the floor in the center of the door. The user then pushes the transmitter or wall button to close the door. The door should reverse when it strikes the wood. If the door does not reverse, the owner should adjust the door or the garage door operator. As such, regular maintenance of many components of the garage door operator is an important aspect of ensuring safe and proper trouble-free operation of the garage door operator.

Presently maintenance schedules, prescribing the service intervals and types of service required to keep the garage door operating properly, typically are printed in the owners manual for the users convenience. Unfortunately, manuals tend to become misplaced, discarded or ignored and their instructions forgotten. In many cases, subsequent home or business owners never are provided the opportunity of reading the owners manual before acquiring the garage door operator. As a result, maintenance schedules may not be followed over significantly long time periods, resulting in unnecessary wear and tear of the equipment and eventual premature failure.

SUMMARY OF THE INVENTION

In accordance with the present invention, there is provided an electronic service reminder to automatically notify a user as to when and what type of maintenance should be performed on the garage door operator, based on a variety of time, materials and environmental factors. For example, the garage door operator produces a notification alert based on the amount of time since the garage door operator was initially installed or since maintenance was performed on the operator previously. Other variables also are used in determining the maintenance schedule, such as the travel distance of the garage door, the life expectancy of the door and springs and the ambient temperature. Thus, the garage door operator is configured to automatically generate an electronic service reminder in the form of an audible or visual alert based on an operating parameter of the garage door operator meeting or exceeding a predefined threshold.

For example, if the garage door has been opened and closed a predefined number of times, then an alert will notify the user that the springs on the door should be checked. Advantageously, the number of usages at which the alert is provided is variable based on the type of spring being used, the distance the door travels when opening and closing or a combination of both. Other operating parameters such as ambient temperature, cycle count and travel distance also maybe used to dynamically vary the thresholds such that as each input parameter is reached, the threshold is immediately varied.

Notification that maintenance is required may take on many forms. In one form, a light or light emitting diode (LED) is activated to light or backlight a display message indicating the type of maintenance required of a user and/or to illuminate a business card of a repair or installation business. Alternatively, an LED display maybe provided to display codes corresponding to the maintenance required. Similarly, a liquid crystal display (LCD) device maybe used to display a text message precisely indicating the required maintenance. In another form, an audible tone or a series of tones is emitted to indicate that the garage door operator requires maintenance. The tone maybe audibly encoded to enable the user to determine the precise nature of the maintenance required. In still another form, a radio frequency (RF) signal is transmitted to a receiving device for generating audio or visual alerts on a remote wireless device. In an additional form, notification is provided by turning the garage door operator overhead light on and off. Thus, there is provided a garage door operator that is able to actively and automatically communicate maintenance requirements to a user relative to conventional garage door operators that require the user to refer to a printed manual for standard time schedules.

The described embodiments are directed to a movable barrier operator, such as a garage door operator, which includes a head unit housing an electric motor. The motor is adapted to drive a transmission that is connectable to the movable barrier. A wired or wireless switch, or a combination thereof, is in communication with a controller housed within the head unit for commanding the head unit to raise or lower the garage door. The controller includes a microcontroller or other processing device interfaced to a non-volatile memory (NVRAM) for storing and retrieving operator related data and other data accumulated by the controller. A receiver communication with the controller is provided for receiving radio frequency (RF) signals from the wireless switch. An overhead light, typically associated with garage door openers, is turned off and on by the controller.

The microcontroller is configured to receive and send various different kinds of data during operation. For example, the microcontroller is interfaced to a force sensor and an ambient temperature sensor for receiving input data regarding the upward and downward forces generated by the door and the ambient air temperature outside the head unit. In addition, the microcontroller receives input data from a cycle counter, time counter and a switch that is set by the user. The microcontroller also includes interfaces for providing output signal data to drive a number of different devices, such as one or more LEDs, LCDs, sound speakers and RF devices. A universal asynchronous receiver transmitter (UART) is provided as a serial communications port, such as an EIA RS-232 port, to enable the controller to communicate with a personal computer (PC).

BRIEF DESCRIPTION OF THE DRAWINGS

Other objects and advantages of the invention will become apparent upon reading the following detailed description and upon reference to the drawings, in which.

DETAILED DESCRIPTION OF THE INVENTION

Figure 1:
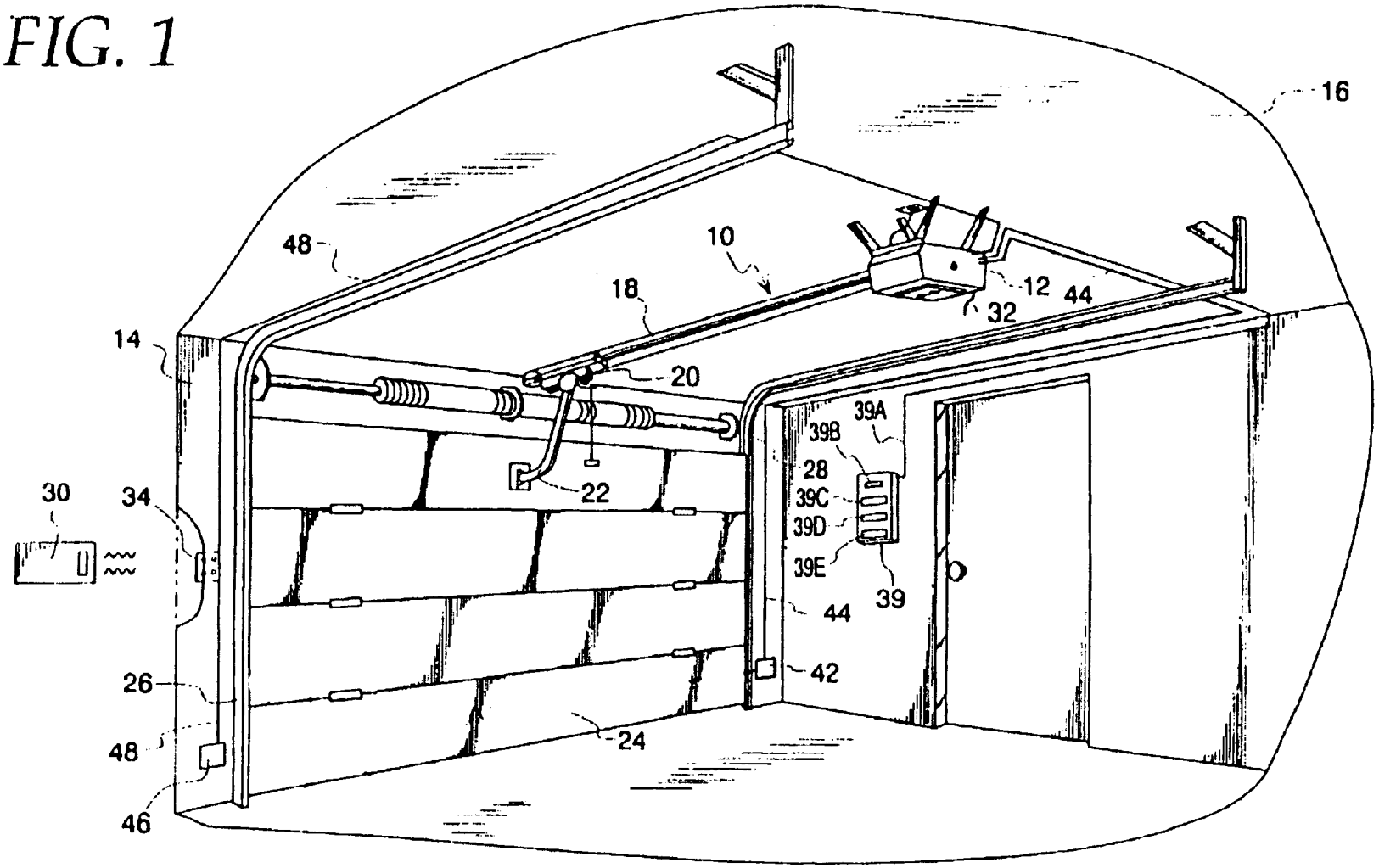
FIG. 1 is a perspective view of a garage door operating system in accordance with an embodiment of the invention.

Referring now to the drawings and especially to FIG. 1, more specifically a movable barrier door operator or garage door operator is generally shown therein and referred to by numeral 10 includes a head unit 12 mounted within a garage 14. The head unit 12 is mounted to the ceiling of the garage 14 and includes a rail 18 extending therefrom with a releasable trolley 20 attached having an arm 22 extending to a multiple paneled garage door 24 positioned for movement along a pair of door rails 26 and 28. The system includes a hand-held transmitter unit 30 adapted to send signals to an antenna 32 positioned on the head unit 12 and coupled to a receiver, as shown hereinafter. An external control pad 34 is positioned on the outside of the garage having a plurality of buttons thereon and communicates via radio frequency transmission with the antenna 32 of the head unit 12. A switch module 39 is mounted on a wall of the garage. The switch module 39 is connected to the head unit by a pair of wires 39*a*. The switch module 39 includes a learn switch 39*b*, a light switch 39*c*, a lock switch 39*d* and a command switch 39*e*. An optical emitter 42 is connected via a power and signal line 44 to the head unit 12. An optical detector 46 is connected to the head unit 12 via a wire 48.

Figure 2:
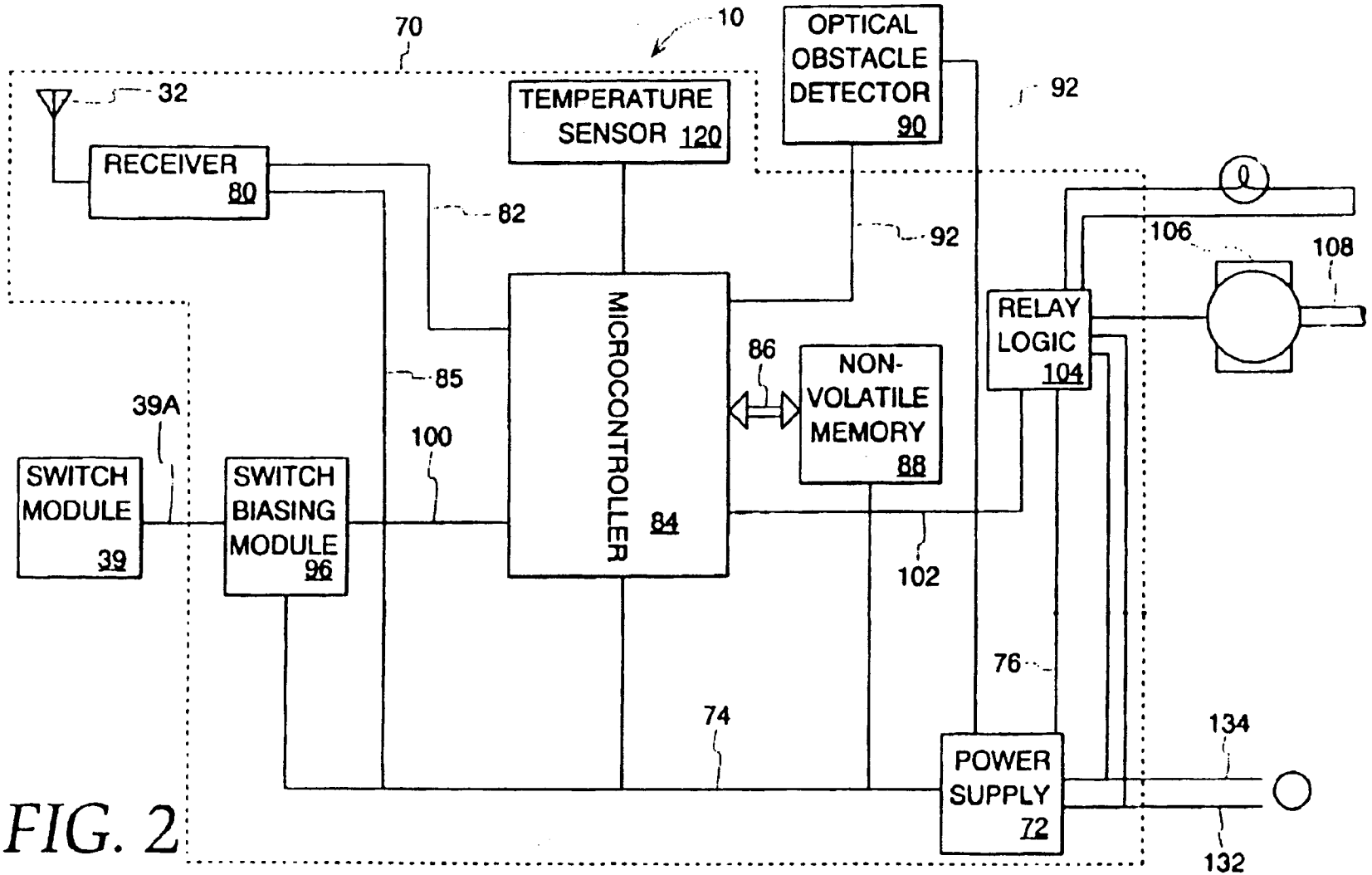
FIG. 2 is a block diagram of a controller mounted within the head unit of the garage door operator employed in the garage door operator shown in FIG. 1.

As shown in FIG. 2, the garage door operator 10, which includes the head unit 12, has a controller 70 that includes the antenna 32. The controller 70 includes a power supply 72 that receives alternating current from an alternating current source, such as 110 volt AC, and converts the alternating current to +5 volts zero and 24 volts DC. The 5 volt supply is fed along a line 74 to a number of other elements in the controller 70. The 24 volt supply is fed along the line 76 to other elements of the controller 70. The controller 70 includes a super-regenerative receiver 80 coupled via a line 82 to supply demodulated digital signals to a microcontroller 84. The receiver 80 is energized by a line 85 coupled to the line 74. Signals may be received by the controller 70 at the antenna 32 and fed to the receiver 80.

The microcontroller 84 is also coupled by a bus 86 to an NVRAM 88, which stores set points and other customized digital data related to the operation of the control unit. An obstacle detector 90, which comprises the emitter 42 and the infrared detector 46 is coupled via an obstacle detector bus 92 to the microcontroller 84. The obstacle detector bus 92 includes lines 44 and 48. The wall switch 39 is connected via the connecting wires 39*a* to a switch biasing module 96 that is powered from the 5 volt supply line 74 and supplies signals to and is controlled by the microcontroller 84 a bus 100 coupled to the microcontroller 84. The microcontroller 84 in response to switch closures, will send signals over a relay logic line 102 to a relay logic module 104 connected to an alternating current motor 106 having a power take-off shaft 108 coupled to the transmission 18 of the garage door operator.

Figure 3:
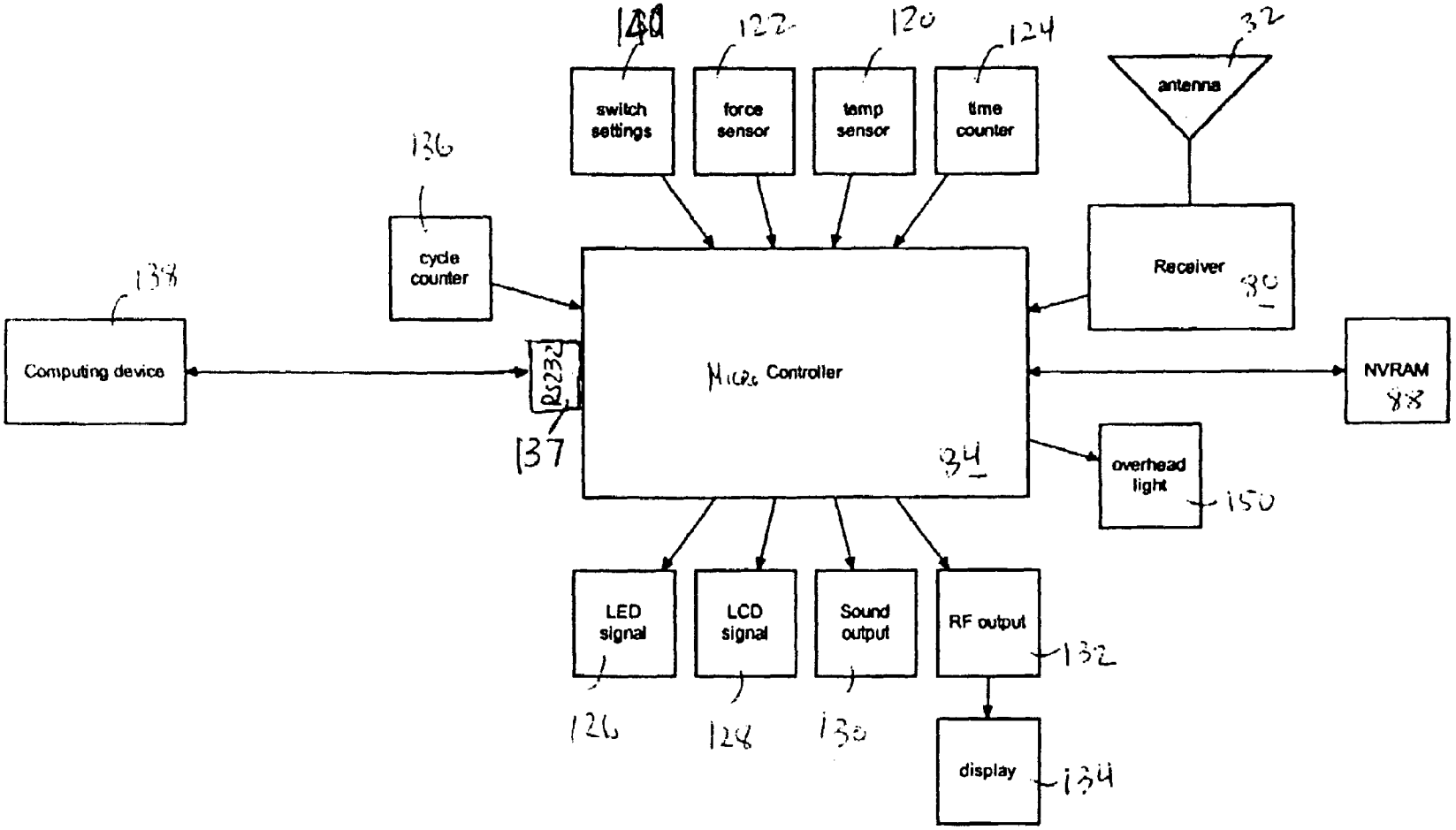
FIG. 3 is a block diagram of input/output devices connected to the microcontroller within the controller shown in FIG. 2.

As further shown in FIG. 3, the microcontroller 84 also is coupled to a number of input devices for receiving external data. These devices include a time counter 124, a temperature sensor 120, a force sensor 122, a cycle counter 136 and a switch 140. The time counter 124 is a real time clock (RTC), such as the Dallas Semiconductor DS1307, for measuring elapsed time. Alternatively, a simple oscillator maybe used instead to generate pulses that are counted by the microcontroller 84 to determine elapsed time or the microcontroller 84 can count its own internal clock. The cycle counter 136 counts the number of opening and closing operations that the garage door operator 10 executes.

The temperature sensor 120, which may be any commonly available temperature sensor such as the National Semiconductor LM75, is placed outside the head unit to measure the ambient temperature of the atmosphere surrounding the garage door operator 10. The microcontroller 84 is able to query the temperature sensor 120 as needed to obtain the ambient temperature in which the garage door operator is operating. The force sensor 122 measures the force required to move the door. This force is an indication all the level of fatigue of the springs. As with the time counter 124, the force sensor 122 maybe a software function of the microcontroller 84.

The results from the input devices are used in a number of ways to determine when and what type of alert is to be generated. For example, the measured elapsed time is used for generating an alert every thirty days to notify a user to perform an obstruction test. In another example, the measured elapsed time is used in conjunction with the number of counted cycles to generate an alert every six months or 1000 cycles of operating cycles, whichever comes first.

A communications port 137, such as an RS232, universal serial bus (USB) or IEEE1394 (typically referred to as a firewire port) or any other communications interface is provided to enable the microcontroller 84 to communicate with an external computing device 138, such as a personal, laptop or handheld computer. In one mode, data that is read from or written to the NVRAM 88 is output on the communications port 137 to enable a user to view the data being transferred into and out of the system using an attached computing device.

The switch 140 is used to specify to the microcontroller 84 various parameters relating to service intervals such as the type of spring being used in the system. A dual inline package (DIP) switch having one or more switch levers maybe used, although any similar type of switch is also acceptable. Based on the position of the switch levers, the microcontroller 84 is able to determine thresholds for identifying a need for service. The microcontroller 84 cross-references the switch settings with the particular characteristics of the installed spring, which are stored in the NVRAM 88. Spring characteristics may include information relating to the predicted lifespan of the spring, optimum operating parameters and spring constant, among others. For example, the switch settings are used to identify whether the spring is a five thousand, ten thousand or fifty thousand cycle spring.

Additional levers on the switch 140, or even another switch (not shown), also are provided to specify to the microcontroller 84 the type or weight of the garage door that the garage door operator 10 is lifting and lowering. The switch settings include preprogrammed positions for indicating within what range of weights the garage door falls.

By determining the number of counted operating cycles, the measured forces on the spring and the measured elapsed time, the threshold at which an alert is generated is determined. For example, if the forces on the garage door show that the springs are no longer counter balancing the total weight of the door, and the door is now 50 pounds heavier, then the spring/cycle threshold is shortened and an alert is generated after a relatively fewer number of operating cycles. The converse is true as well. Thus, advantageously, by having a precisely tailored maintenance regimen, the life of the springs is extended.

Figure 4:
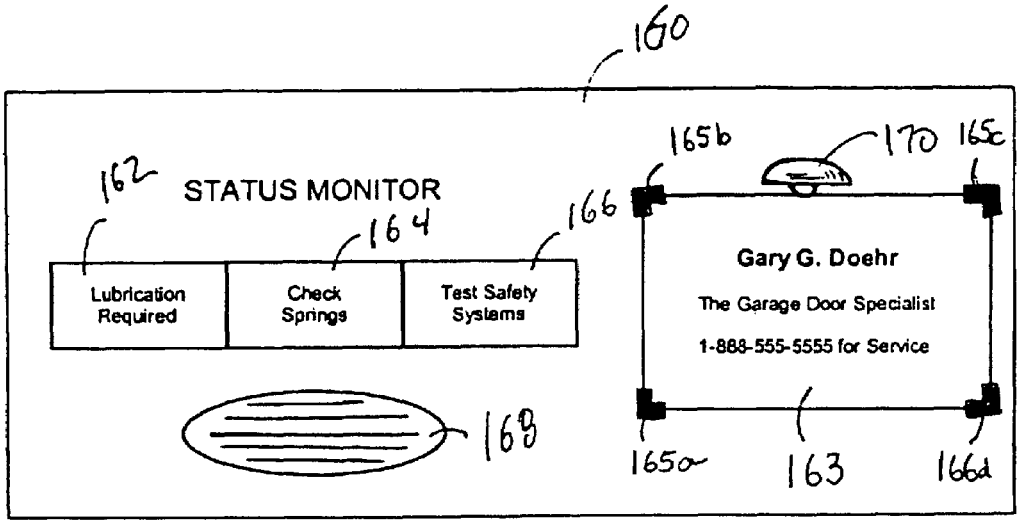
FIG. 4 is a service reminder display unit for housing service reminder alerting devices.

The microcontroller 84 also provides several output ports that the garage door operator 10 uses to produce signals alerting users that maintenance of the garage door operator 10 maybe necessary. The microcontroller 84 provides an LED output signal 126 for driving an LED (not shown) or an LED display 172, 174 (FIG. 4). Alternatively, or in addition to the LED output signal 126, the microcontroller 84 provides an LCD signal 128 for enabling text-based messages to be displayed on an LCD 176 (FIG. 4). A sound output 130 generates signals for driving a speaker, preferably placed behind a protective speaker grill 168 (FIG. 4). The sound output signal 130 maybe modulated so that a user is able to determine the type of maintenance that is required by simply listening to the sound coming from the speaker. In addition, an RF transmitter 132 is provided as well to enable wireless messages to be sent to an RF signal-receiving device for enabling alerts from the microcontroller 84 to be transmitted to a remote wireless device (not shown) or to the display unit 160 (FIG. 4). The RF transmitter 132 also maybe configured as a transceiver device that is capable of receiving and transmitting RF commands from a remote source (not shown) or from the display unit 160.

Referring to FIG. 4, several exemplary embodiments of the service reminder are shown. The display unit 160 is configured as a housing unit into which the service reminder alerts are mounted. As shown by way of example only, since other messages in various other configurations are also possible, the display unit 60 includes several reminder message panels, including "Lubrication Required" 162, "Check Springs" 164 and "Test Safety Systems" 166. The message panels 162, 164, 166 are constructed of a light weight plastic or glass material of a predetermined color, such as red or orange. The messages themselves are printed using a white glass or plastic material. The display unit 160 is configured with a recess (not shown) into which an LED in communication with the microcontroller 84 via the LED signal 126 is fitted. The LED is fitted into the recess such that when the message panel 162 is affixed to the display unit 160, the LED is completely covered by the message panel 162. Thus, when the LED receives the LED signal 126 and turns on, the message panel 162 will display brightly a service reminder message indicating the type of service required. Each message panel is configured similarly, such that depending on the LED being illuminated, the appropriate panel and message is illuminated.

A speaker connected to the sound output 130 of the microcontroller 84 for sounding an audible alert message is mounted behind a protective grill 168 on the display unit 160. Thus, a user who may not notice the activation of LEDs, will also be provided with an alert tone when the microcontroller 84 generates a sound output signal. If the alert tone is coded, then the user is able to decode the coded tones to determine the service required on the garage door operator 10. Alternatively, a tone from the speaker 168 will alert the user to the fact that the display unit 160 needs to be examined for pending service reminder messages. Alternatively the sounds from the speaker can be modulated to create speech.

An additional feature that is provided is a holder for a business card 163 or note paper indicating a telephone number of a garage door operator service technician or the like. The card 163 is held in place by four corner-holders 165*a*, 165*b*, 165*c*, 165*d* underneath a lighting device 170, such as a small incandescent light bulb or white LED. Alternatively, a lighting device (not shown) is mounted behind the business card 163 to illuminate the business card 163 from the reverse side, such that the business card 163 lights up when the lighting device is turned on. The lighting device in the alternate configuration is, like the LEDs, inserted into a recess such that the business card 163 is able to sit flush against the base unit.

Figure 5:
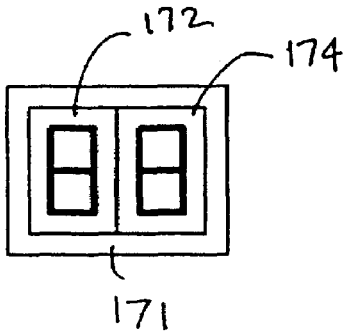
FIG. 5 is an LED display for mounting in the display unit of FIG. 4 for displaying service reminder codes.

Referring to FIG. 5, an LED display 171 is shown comprising two seven-segment displays 172, 174. In an alternate embodiment, the LED display 171 is installed in place of the message panels 162, 164, 166 (FIG. 4). As such, when an LED signal 126 from the microcontroller 84 (FIG. 3) is generated, the LED display 171 will output a alphanumeric code representative of the maintenance required by the garage door operator 10. The user is then able to cross reference the code to a user manual or a chart that maybe located near the display unit 160.

Figure 6:
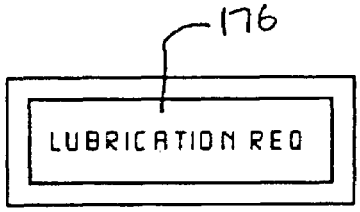
FIG. 6 is an LCD display for mounting in the display unit of FIG. 4 for displaying text based service reminder messages.

Referring to FIG. 6, an LCD display 176 is shown wherein in an alternate embodiment the LCD display 176 is installed into the display unit instead of either the LED display 171 or the message panels 162, 164, 166. A particular advantage of the LCD display 176 is its ability to display text-based messages. In particular, the microcontroller 84 (FIG. 3) produces an LCD signal that enables a variety of specific messages to be displayed on the LCD display 176 to explicitly indicate to the user the service that needs to be performed on the garage door operator. In another aspect, the microcontroller 84 is programmed to generate an LCD display signal that scrolls across the face of the display, thereby enabling short messages to appear. Such messages may include specific operating parameter information or the name and number of a preferred service provider.

Referring to FIGS. 4-6, in the foregoing discussion it was shown that the alerting devices mounted on the display unit 160 are connected to their respective signaling lines from the microcontroller 84. It is to be noted that the connection is accomplished in one of many ways, including wired, wireless or a combination of both. In a particular embodiment, the display unit 160 includes a mounted RF transceiver (not shown) for receiving and transmitting signals to an RF transceiver in the controller 70. Preferably, short-range wireless signals are used, such as Bluetooth, for communicating between the transceivers. However, other RF signaling protocols also maybe used including one-way communications methods.

Figure 7:
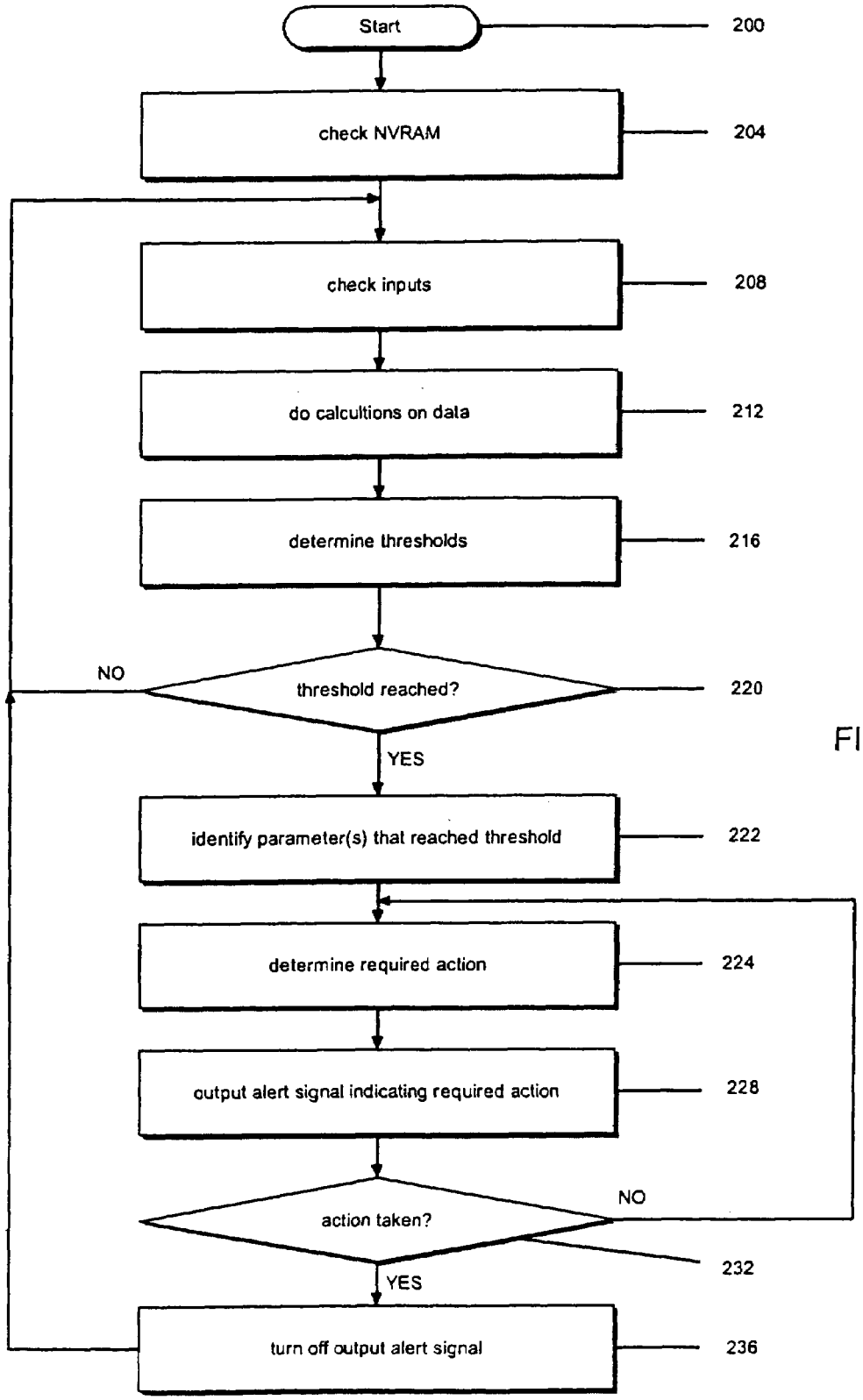
FIG. 7 is a flow diagram of a service reminder routine executed by the microcontroller.

Referring to FIG. 7, the garage door operator is shown in operation. Upon initial power-on in step 200 the microcontroller checks the NVRAM in step 204 to determine whether any existing operating data is stored. A checksum validation also maybe performed to ensure that the data is valid, particularly if the system is being activated for the first time. The microcontroller then begins receiving input from the sensors, including the force sensor, temperature sensor and time counter in step 208. More particularly, the system enters a monitoring mode of operation where the microcontroller accumulates operating data from the various input sensors as the garage door operator is used. The data from the sensors includes the ambient temperature in which the garage door operator is operating, a running total of the number of times the door has been lifted and closed and the force difference between opening and closing of the door.

Based on the input data parameters from the various sensors, the microcontroller calculates in step 212 initial threshold values based on a function of the present and past data received by the sensors. In another aspect, the system is configured with an additional variable that is used to accrue variations in the input parameters and the threshold is based on this mathematical variable.

The threshold values are a result of the calculations performed on the input data and are variable depending on the change in the data values. For example, if the ambient temperature experiences a decrease, then the spring life may be extended by a certain time period. As such, the service reminder to check the springs may be delayed by an amount of time beyond that recommended in the owners manual. Similarly, if the ambient temperature experiences an increase, lubrication may be required at a time slightly earlier than recommended in the manual. Threshold determination is dynamic and variable in that the threshold values may change immediately as data is read from the sensors and varies based on the values of the inputs received by the sensors. If the threshold values are met or exceeded, an alert is generated. The threshold values are then set in step 216. That is, the microcontroller will generate a signal on at least one of the alert outputs if a threshold value is met or exceeded as determined in step 220.

In step 220, the microcontroller determines whether any of the threshold values determined in step 216 has been met or exceeded. If no threshold value has been met or exceeded in step 220, the microcontroller returns to step 208 and continues collecting operating data. However, if a threshold value has been reached or exceeded during operation of the garage door operator, in step 222 the particular parameter or parameters that reached the threshold limit is identified. Based on the identity of the parameters and the algorithm used in determining threshold values the particular type of maintenance required is determined in step 224. In step 228 an output alert signal is generated by the microcontroller to illuminate the proper LED/message panel or display the appropriate LCD text message and sound the appropriate tones.

Subsequent to the service reminder alert being generated, the system in step 232 determines whether any action has been taken in response to the reminder message sufficient to disable the output alert signal. Several valid responses are available. First, a test of the safety system maybe conducted that includes reversal of the garage door due to a force obstruction to confirm that the safety system has been tested. Alternatively, the system may turn off the alert based on a period of elapsed time or number of operations of the garage door operator lifting and lowering the garage door. Additional valid responses include one or more operations from the wall or keyless entry controls, a power on reset or even any specific command input as determined by the user. Accordingly, if any of the enumerated responses are received, the microcontroller will turn off the outputs in step 236 and continue accumulating operating data in step 208.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. Movable barrier operator for opening and closing a movable barrier comprising:

a cycle counter accumulating a count of opening and closing cycles of the movable barrier;

input apparatus accumulating operating data including at least one of ambient temperature, barrier movement force, barrier travel distance and elapsed time;

a spring for assisting the movable barrier operator in opening and closing the barrier, the spring having predetermined characteristics including a nominal threshold number of opening and closing cycles;

a controller identifying the predetermined characteristics of the spring and being responsive to the accumulated operating data and the nominal threshold number of opening and closing cycles to determine a dynamic threshold number of opening and closing cycles; and an alert state generator generating an alert state in response to the count of opening and closing cycles exceeding the dynamic threshold.

2. The movable barrier operator of claim 1, wherein the alert is activated based on a result of a function of the number of cycles counted by the cycle counter, the operating data and the predetermined characteristics of the spring having reached a second predefined threshold.

3. The movable barrier operator of claim 2, further comprising a user controlled input device for identifying the predetermined characteristics of the spring assisting the barrier.

4. The movable barrier operator of claim 1, wherein the alert state indicates that the spring requires service.

5. The movable barrier operator of claim 4, wherein the alert state is a visual indicator comprising an LED configured to turn off and on.

6. The movable barrier operator of claim 4, wherein the alert state comprises an LCD configured to display the existence of an alert condition and to display information regarding a required service.

7. The movable barrier operator of claim 1, wherein the alert state is activated based on a result of a function of distance traveled by the barrier between opening and closing.

8. The movable barrier operator of claim 1, wherein the value of the dynamic threshold varies based on the operating data received by the controller.

* * * * *